US010272543B2

(12) United States Patent
Funatsu et al.

(10) Patent No.: US 10,272,543 B2
(45) Date of Patent: Apr. 30, 2019

(54) NOZZLE

(71) Applicant: SUGINO MACHINE LIMITED, Uozu, Toyama Prefecture (JP)

(72) Inventors: Akihiro Funatsu, Uozu (JP); Sachie Ejiri, Toyama (JP)

(73) Assignee: SUGINO MACHINE LIMITED, Uozu (JP)

( * ) Notice: Subject to any disclaimer, the term of this patent is extended or adjusted under 35 U.S.C. 154(b) by 0 days.

(21) Appl. No.: 15/092,245

(22) Filed: Apr. 6, 2016

(65) Prior Publication Data

US 2016/0361795 A1 Dec. 15, 2016

(30) Foreign Application Priority Data

Jun. 9, 2015 (JP) ..... 2015-116513

(51) Int. Cl.

| | |
|---|---|
| ***B05B 7/14*** | (2006.01) |
| ***B05B 7/32*** | (2006.01) |
| ***B05B 1/34*** | (2006.01) |
| ***B24C 5/04*** | (2006.01) |
| ***B24C 3/32*** | (2006.01) |
| *B05B 7/20* | (2006.01) |
| *B05B 7/24* | (2006.01) |

(52) U.S. Cl.

CPC ..... *B24C 5/04* (2013.01); *B05B 1/34* (2013.01); *B05B 1/3402* (2018.08); *B05B 7/149* (2013.01); *B05B 7/32* (2013.01); *B24C 3/327* (2013.01); *B05B 7/14* (2013.01); *B05B 7/1418* (2013.01); *B05B 7/205* (2013.01); *B05B 7/2443* (2013.01)

(58) Field of Classification Search

CPC ..... B05B 7/205; B05B 7/2443; B05B 7/1418; B05B 7/14; B05B 7/32; B05B 1/34; B64C 3/327; B64C 5/04

USPC ... 239/310, 315, 325, 336, 79, 85, 434, 426; 222/321.2

See application file for complete search history.

(56) References Cited

U.S. PATENT DOCUMENTS 2,503,481 A * 4/1950 Hallinan ..... B05B 1/3442 239/462
2,805,966 A * 9/1957 Etheridge ..... C08B 30/16 127/28

(Continued)

FOREIGN PATENT DOCUMENTS

JP 2013-107202 A 6/2013

*Primary Examiner* — Steven J Ganey
*Assistant Examiner* — Joseph A Greenlund
(74) *Attorney, Agent, or Firm* — Oliff PLC

(57) ABSTRACT

A nozzle ejecting liquid and nozzle device ejecting a liquid upon mixing an abrasive into a liquid jet stream, obtains a converged jet stream. A nozzle includes: a main body; a buffer chamber in the body, whose central axis is an axis line being the liquid jet stream central line; a constrictor part ejecting the liquid, in a buffer chamber plane on a buffer chamber front side and whose central axis is the axis line; a disk plate inside the buffer chamber, facing the plane on the buffer chamber front side and whose central axis is the axis line; a supporting member supporting the disk plate within the buffer chamber; a supply opening in the body supplying the liquid; and an inflow channel along a direction different from the axis line extending direction, opened on a disk plate rear side and the buffer chamber and communicating with the opening.

7 Claims, 10 Drawing Sheets

(56) References Cited

U.S. PATENT DOCUMENTS 4,260,110 A * 4/1981 Werding ..... B05B 1/3436 239/404
4,478,368 A * 10/1984 Yie ..... B05B 7/1431 239/430
4,537,358 A * 8/1985 Anderson ..... B05B 7/12 239/413
4,563,840 A * 1/1986 Urakami ..... B24O 5/04 239/120
4,899,937 A * 2/1990 Haruch ..... B05B 1/267 239/289
5,876,267 A * 3/1999 Kanda ..... B24C 5/04 451/102
6,283,386 B1 * 9/2001 Van Steenkiste ..... B05B 7/1486 118/308
6,412,708 B1 * 7/2002 Bohringer ..... A61H 33/027 239/407
6,623,796 B1 * 9/2003 Van Steenkiste ..... B05B 7/1486 427/189
6,811,812 B2 * 11/2004 Van Steenkiste ..... C23C 24/04 427/189
6,858,340 B2 * 2/2005 Sugawara ..... F04F 5/461 239/124
6,872,427 B2 * 3/2005 Van Steenkiste ..... B05B 7/1486 427/191
6,939,205 B2 * 9/2005 Hopf ..... B24C 1/083 451/102
7,108,893 B2 * 9/2006 Van Steenkiste ..... C23C 4/12 427/446
7,125,586 B2 * 10/2006 Van Steenkiste ..... C23C 24/04 427/448
7,237,308 B2 * 7/2007 Dixon ..... D04H 18/00 28/104
7,335,341 B2 * 2/2008 Van Steenkiste ..... H05H 1/24 422/186.04
7,351,450 B2 * 4/2008 Fuller ..... C23C 4/02 427/140
7,475,831 B2 * 1/2009 Van Steenkiste ..... B05B 7/1486 118/308
7,547,292 B2 * 6/2009 Sheldrake ..... A61M 5/3015 604/68
7,900,812 B2 * 3/2011 Teets ..... B23K 20/002 228/261
7,934,977 B2 * 5/2011 Hashish ..... B24C 1/045 451/102
8,017,275 B2 * 9/2011 Fukuma ..... F04F 5/461 417/178
8,448,880 B2 * 5/2013 Hashish ..... B24C 3/325 239/426
2007/0165060 A1 * 7/2007 Helmig ..... B24O 3/325 347/20
2011/0229649 A1 * 9/2011 Baranovski ..... B05B 7/0815 427/446
2013/0087634 A1 * 4/2013 Nagel ..... F02M 53/04 239/128
2014/0263700 A1 * 9/2014 Hedger ..... B05B 7/0483 239/8
2014/0346250 A1 * 11/2014 Magi ..... F04F 5/461 239/310
2015/0263700 A1 * 9/2015 Yasumoto ..... H01L 29/205 310/313 B
2016/0069498 A1 * 3/2016 Sato ..... F16L 41/021 285/133.11
2016/0129551 A1 * 5/2016 Kata ..... B24O 5/04 451/102
2016/0361795 A1 * 12/2016 Funatsu ..... B05B 1/34

* cited by examiner

NOZZLE

BACKGROUND OF THE INVENTION

1. Field of the Invention

The present invention relates to a nozzle that ejects liquid, and a nozzle device that ejects liquid upon mixing abrasives into a jet stream of the liquid.

2. Description of the Related Art

There has been proposed a nozzle to be inserted inside a narrow spot, into which a high pressure fluid is flown along a longitudinal direction, and which ejects fluid including abrasives in a direction different from the longitudinal direction (for example, Japanese Unexamined Patent Publication No. 2013-107202 (paragraphs [0031]-[0035], FIGS. 1~3)).

In the nozzle disclosed in Japanese Unexamined Patent Publication No. 2013-107202, a fluid flow conduit provided in a main body of the nozzle has a redirector (elbow) where the fluid flowing in a first direction is redirected into a second direction. The fluid flow conduit further provides a nozzle orifice along the redirected second direction. An abrasive medium is mixed into the fluid ejected from this nozzle orifice, and the fluid is ejected in the second direction.

SUMMARY OF THE INVENTION

In the conventional art, when a high-pressure fluid is redirected, the flow becomes turbulent. A jet stream then ejected from an orifice (constrictor part) provided downstream of the redirector disperses. When the jet stream disperses, the processing ability of the jet stream decreases as compared to a case in which the jet stream is converged.

Moreover, when an abrasive medium (abrasive) is mixed into the dispersed jet stream and this jet stream including the abrasive medium is ejected, a ejection conduit (ejection pipe) wears intensively. Furthermore, since the jet stream including the abrasive medium is dispersed, the processing ability of the jet stream is low and the processed surface is easily disordered.

An object of the present invention is to obtain a converged jet stream with a nozzle that ejects liquid, and a nozzle device that ejects liquid upon mixing abrasives into a jet stream of the liquid.

In view of the above issues, a nozzle of the present invention is a nozzle adapted to eject liquid, including: a main body; a buffer chamber provided in the main body, whose central axis is an axis line serving as a center line of a jet stream of the liquid; a constrictor part adapted to eject the liquid, provided on a plane of the buffer chamber on one side of a direction of the axis line and whose central axis is the axis line; a disk plate provided inside the buffer chamber, the disk plate facing the plane of the buffer chamber on the one side and whose central axis is the axis line; a supporting member adapted to support the disk plate within the buffer chamber; a supply opening provided in the main body, adapted to supply the liquid; and an inflow channel provided along a direction different from an extending direction of the axis line, the inflow channel opened on the other side of the disk plate and the buffer chamber opposite to the one side and communicating with the supply opening.

According to the above configuration, the liquid introduced from the inflow channel spreads throughout the other side of the disk plate (side opposite to the constrictor part) within the buffer chamber, and flows into the one side (constrictor part side) of the disk plate within the buffer chamber from surroundings of the disk plate. The liquid flown into a disk-plate-shaped space formed on the constrictor part side of the disk plate flows from the whole circumference of the disk-plate-shaped space to towards a center part through which the axis line passes substantially equally. The liquid is rectified by passing between the disk plate and a wall of the buffer chamber facing the disk plate. The flow of the liquid gathers into the center part of the disk-plate-shaped space, and suddenly contracts in flow in the axis line direction towards the constrictor part and rotates the direction of the flow. By the liquid ejecting from the disk-plate-shaped space upon passing through the constrictor part, a jet stream with small turbulence is obtainable.

Moreover, since the flow channel is configured of the buffer chamber and the disk plate supported inside the buffer chamber, the inflow channel is extremely compact, while achieving a high rectifying effect.

That is to say, according to the present invention, it is possible to obtain a converged jet stream with the nozzle that ejects liquid.

In the nozzle of the present invention, it is preferable that the buffer chamber has an internal space whose outer shape is of a cylinder.

Since the outer shape of the internal space of the buffer chamber is cylindrical, the inflow channel structure within the nozzle is extremely compact, and a nozzle with a small exterior dimension is obtainable.

Here, the term cylindrical is not intended to limit the shape to an exact cylinder based on geometry, and will include, for example, a barrel shape whose middle part is slightly broadened in diameter, and a shape whose part of its corners is rounded.

In the nozzle of the present invention, it is preferable that the disk plate have a groove provided on a plane of the disk plate on the one side.

According to the configuration, the disk-plate-shaped space formed between the disk plate and the plane of the buffer chamber facing the disk plate protrude into the other side of the constrictor part. By providing a space into which liquid is supplied in the opposite side of the constrictor part, a strong flow along the axis line generates upstream of the constrictor part, and the degree of vortex generation in the vicinity of the constrictor part (vorticity) decreases. Therefore, a jet stream having further low turbulence is obtainable.

In the nozzle of the present invention, it is preferable that the groove has an internal space whose outer shape is of a cylinder and whose central axis is the axis line, or of a cone whose section broadens as the internal space approaches the one side.

According to the above configuration, a jet stream having further low turbulence is obtainable since a strong flow along the axis line generates more uniformly in a circumferential direction upstream of the constrictor part. Moreover, groove formation is easy.

Here, the term cylindrical shape does not intend to limit the shape to an exact cylinder based on geometry. Similarly, the term conical shape does not limit the shape to an exact cone based on geometry, and may be any shape as long as its lateral section (a section cut at a flat plane perpendicular to the axis line) is shaped as a circle and its vertical section (a section cut at a flat plane including the axis line) is shaped substantially trapezoidal.

In the nozzle of the present invention, it is preferable that the supporting member have a shaft provided on a plane of the disk plate on the other side, and the shaft be of a cylindrical shape whose central axis is the axis line.

According to the configuration, since the disk plate is supported by the cylindrical shaft from the opposite side of the constrictor part, the supporting member does not inhibit the flow of the liquid within the buffer chamber. Therefore, the generation of the vortex within the buffer chamber is minimized, and the flow within the disk-plate-shaped space between the disk plate and the wall of the buffer chamber on the constrictor part side facing the disk plate is more rectified. The jet stream ejecting from the constrictor part is largely affected by the turbulence in the liquid on the upstream side of the contraction. Hence, a jet stream with lower turbulence is obtainable by preventing the generation of the vortex within the buffer chamber.

In the nozzle of the present invention, it is preferable that the supporting member have a shaft provided on a plane of the disk plate on the other side, and the shaft include a streamline shaped section through which the axis line passes and which resistance received from the liquid sent through the inflow channel is reduced.

According to the configuration, the liquid flowing into the buffer chamber from the inflow channel impinges on the supporting member, and the flow of the liquid does not exfoliate from the surface of the supporting member when separating from the supporting member. Therefore, the generation of a vortex is prevented within the buffer chamber, and a jet stream with lower turbulence is obtainable.

In the nozzle of the present invention, it is preferable that the one side of the buffer chamber be opened, the constrictor part be provided in a hollow cylindrical constrictor member whose central axis is the axis line, the constrictor member be provided to close the opening on the one side of the buffer chamber, and the nozzle further include a housing having a reception chamber adapted to contain the constrictor member and a jet stream flow channel provided on the same axis as the axis line, the jet stream flow channel opened on the one side and communicated with the reception chamber, and a pressing member adapted to sandwich the constrictor member contained within the reception chamber between the housing and the main body by pressing and fixing the housing toward the main body.

According to the above configuration, the buffer chamber is configured by opening the one side (constrictor part side) of the buffer chamber and closing the opened side of the buffer chamber with the constrictor member. Therefore, it is easy to produce the constrictor part and the buffer chamber. A plane upstream of the constrictor member that configures the plane of the buffer chamber is externally exposed before being attached to the main body of the constrictor member; it is thus easy to produce this surface smooth.

Moreover, since the nozzle is configured by containing the constrictor member inside the housing and pressing the housing for fixing the housing to the main body, the constrictor member is easily exchangeable.

In the nozzle of the present invention, it is preferable that the main body have an insertion hole provided on the same axis as the axis line and opened on the other side of the main body, the insertion hole communicating with the buffer chamber, that the supporting member be disposed passing through the insertion hole, and that the nozzle further includes a sealing member adapted to seal between the supporting member and the insertion hole, and a fixing member adapted to fix the supporting member to the main body from the other side.

According to the above configuration, the nozzle can be conveniently produced.

A nozzle device of the present invention is a nozzle device having the nozzle, adapted to eject liquid upon mixing an abrasive into a jet stream of the liquid, the nozzle device including: a hollow cylindrical mixing section provided on the one side of the constrictor part, communicating with the constrictor part and on the same axis as the axis line, the mixing section having an abrasive flow inlet via which the abrasive is flowed into along a direction different from an extending direction of the axis line; and a hollow cylindrical ejection conduit provided on the one side of the mixing section, communicating with the mixing section and on the same axis as the axis line.

According to the above configuration, a nozzle device is obtainable, which nozzle device uses a jet stream of the liquid from the nozzle with high convergence to mix the abrasive and eject the liquid. Since the convergence of the liquid jet stream is high, the straightness of the jet stream in which the abrasive is mixed is high. Therefore, according to the above configuration, it is possible to prevent the wearing of the ejection conduit caused by the abrasive.

DETAILED DESCRIPTION OF THE PREFERRED EMBODIMENTS

According to the present invention, a convergent jet stream is obtainable in a nozzle that ejects liquid and a nozzle device which ejects liquid upon mixing an abrasive into a jet stream of the liquid.

(Structure)

Figure 1:
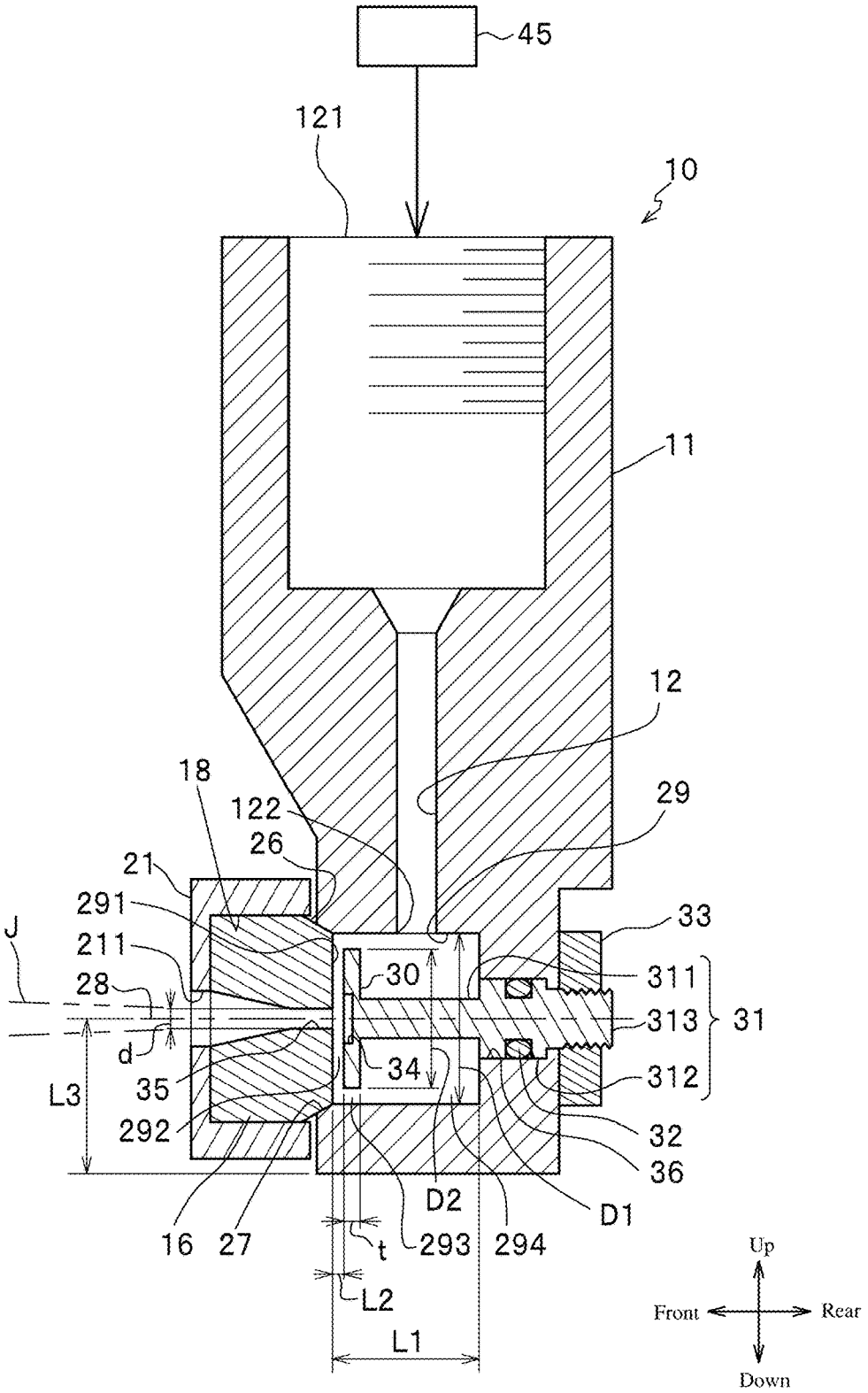
FIG. 1 shows a longitudinal sectional view of a nozzle in the present embodiment.
Figure 2:
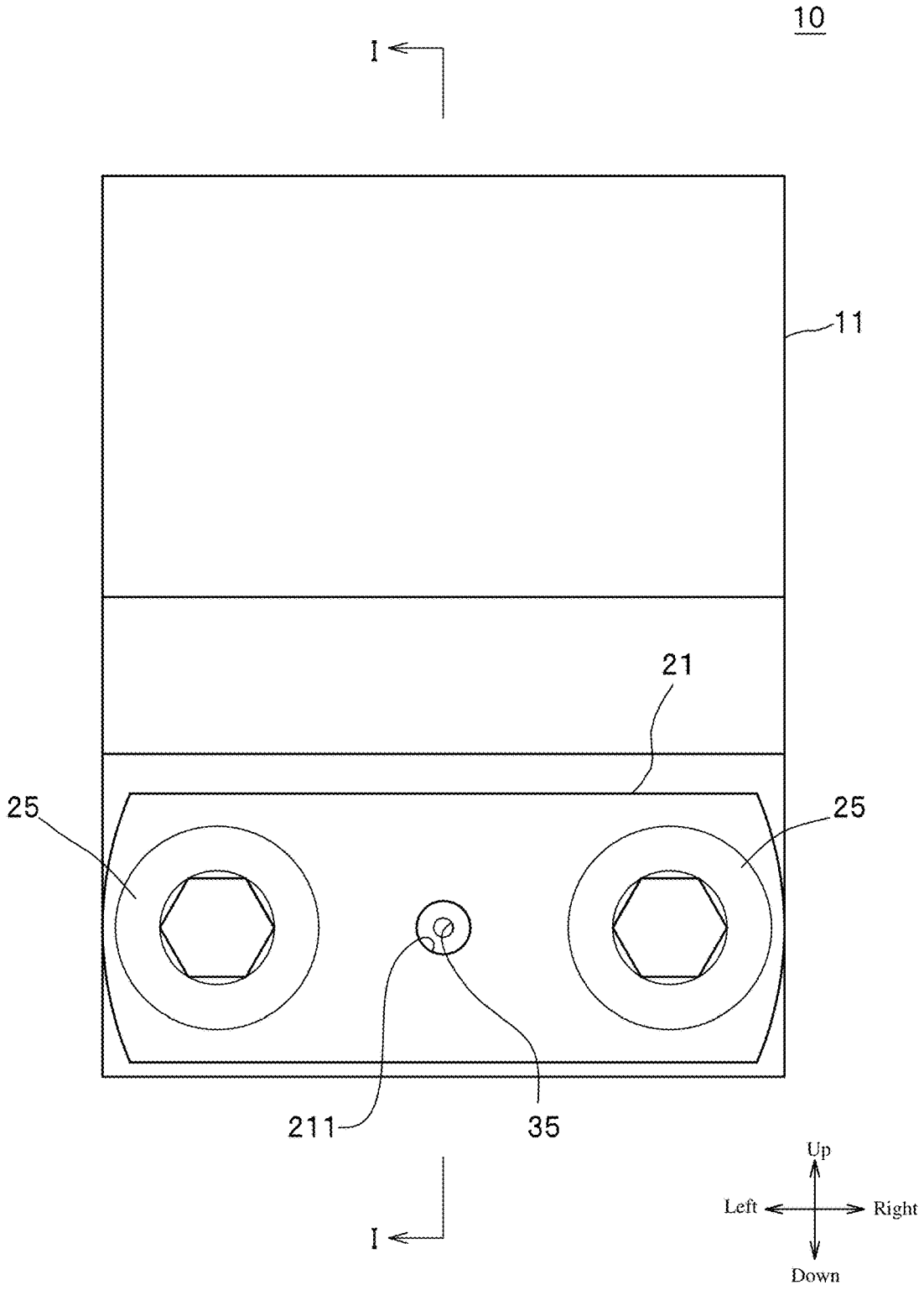
FIG. 2 shows a front view of the nozzle in the present embodiment.
Figure 3:
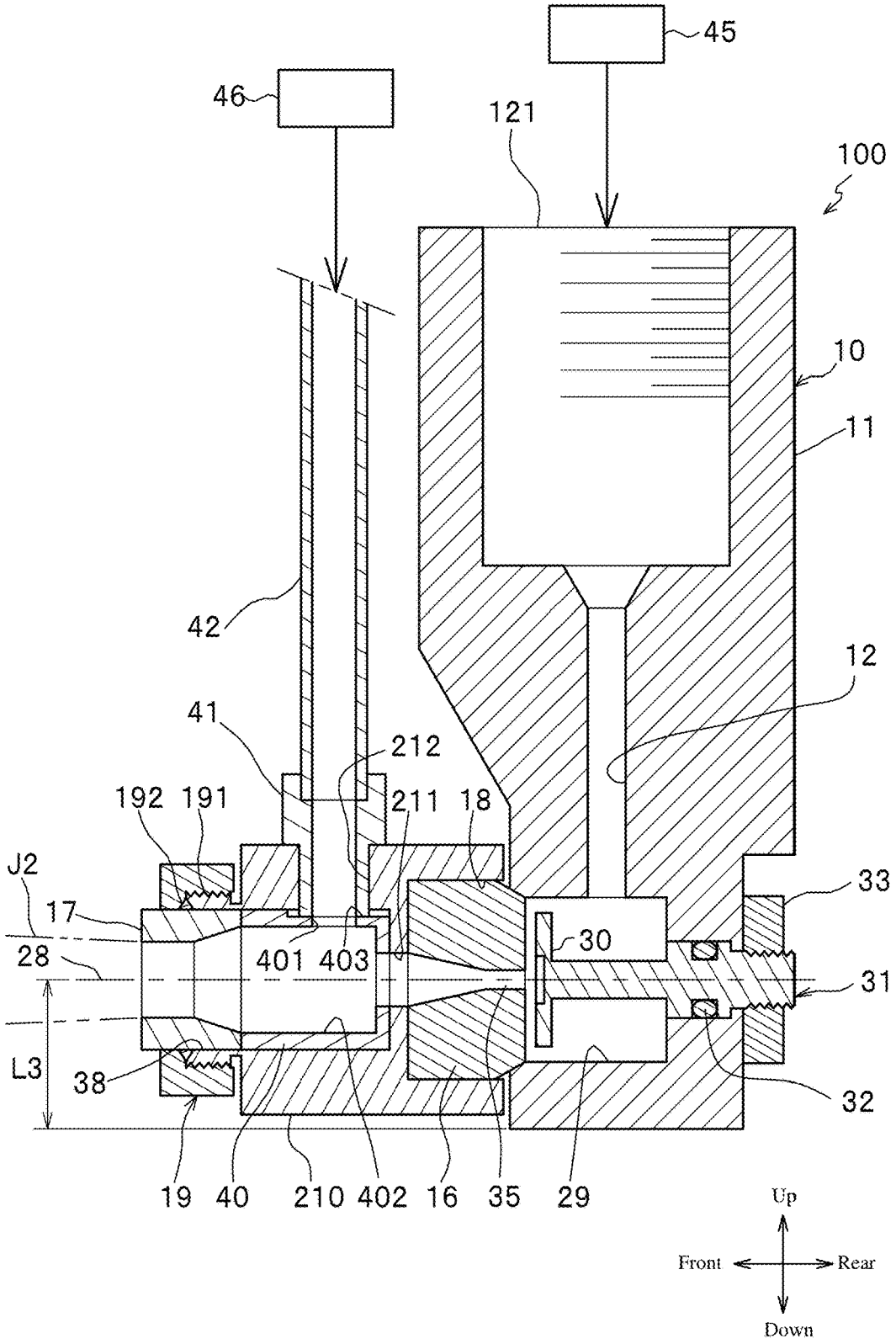
FIG. 3 shows a longitudinal sectional view of a nozzle device in the present embodiment.

With reference to the drawings, details of an embodiment of the present invention will be described. FIG. 1 shows a sectional view taken along line I-I in FIG. 2. FIG. 2 is a front view of a nozzle 10. FIG. 1 and FIG. 2 show the bottom half of the drawing in an enlarged manner, to describe the structure of an inflow channel. In the following descriptions, for convenience, directions in FIG. 1 and FIG. 3 are called as follows: left direction as "front", right direction as "rear", upwards direction as "up", and downwards direction as "down" (or bottom). Moreover, in FIG. 2 and FIG. 4, the right direction and left direction are called "right" and "left", respectively.

A nozzle 10 includes: a main body 11; a buffer chamber 29 provided in the main body 11, whose central axis is an axis line 28 that is the central line of a jet stream J of the liquid; a constrictor part 35 for ejecting the liquid, provided in a plane 291 of the buffer chamber 29 on a front side thereof as one side of a direction of the axis line 28 and whose central axis is the axis line 28; a disk plate 30 provided inside the buffer chamber 29, the disk plate 30 facing the plane 291 of the buffer chamber 29 on the front side thereof and whose center axis is the axis line 28; a supporting member 31 for supporting the disk plate 30 within the buffer chamber 29; a supply opening 121 provided in the main body 11 for supplying the liquid; and an inflow channel 12 provided along a direction different from an extending direction of the axis line 28, the inflow channel 12 opened on a side rear of the disk plate 30 of the buffer chamber 29, which rear side serves as the other side, and which inflow channel 12 communicates with the supply opening 121.

The main body 11 is a substantially rectangular parallelepiped block. The supply opening 121 for supplying the liquid to be ejected is provided in an upper part of the main body 11. Furthermore, the axis line 28 lies in a lateral direction (in the embodiment, a front-rear direction) in a lower part of the main body, which axis line 28 is the center through which the liquid is ejected. The buffer chamber 29 is provided in the center of the lower part of the main body 11. On a rear side of the lower part of the main body 11, an insertion hole 36 is provided, which insertion hole 36 has a step of a smaller diameter. The front side of the lower part of the main body is partially cut out, to house a housing 21. The main body 11 is made of material that is corrosion-resistant to liquid and that can resist pressure of the fluid, such as austenitic stainless steel and precipitation hardening stainless steel.

The inflow channel 12 is provided in the main body 11. The supply opening 121 of the inflow channel 12 is provided in the upper part of the main body 11. A flow outlet 122 of the inflow channel 12 is provided rear of the disk plate 30 of the buffer chamber 29. Since the flow outlet 122 is provided rear of the disk plate 30, the liquid flown out from the flow outlet 122 to the buffer chamber 29 does not disturb the structure of the flow in the rectification space 292 later described. The inflow channel 12 intersects at right angles with the axis line 28. A liquid supply means 45 is connected to the supply opening 121 via a pipe. As the liquid supply means 45, an ultrahigh pressure pump may be used, which generates a high pressure of 100 MPa to 500 MPa.

The inflow channel 12 and the axis line 28 need not to be perpendicular to each other; the inflow channel 12 and the axis line 28 face different directions.

The buffer chamber 29 is a substantially cylindrical hole provided near the bottom plane (lower of) the main body 11, having the axis line 28 serve as its center. The outer shape of the internal space of the buffer chamber 29 is of a cylindrical shape. The buffer chamber 29 has a section larger than a section of the inflow channel 12. The buffer chamber 29 may be of a barrel shape whose middle part is slightly broadened in diameter. Moreover, corner sections thereof may be rounded.

The front side of the buffer chamber 29 is opened. The constrictor part 35 is provided in a constrictor member 16 shaped of a hollow cylinder whose central axis is the axis line 28. The constrictor member 16 is provided so as to close an opening on the front side of the buffer chamber 29. The opening of the buffer chamber 29 is closed and liquid sealed by the plane 291 of the constrictor member 16, to obtain a sealed space. The plane 291 of the constrictor member 16 defines a plane on the front side of the buffer chamber 29. The opening of the buffer chamber 29 in the main body 11 has a tapered plane 27 with a smoothly finished surface. Since the outer shape of the internal space of the buffer chamber 29 is of a cylindrical shape, an inflow channel structure of inside the nozzle 10 becomes extremely compact. Therefore, a nozzle 10 having a small exterior dimension is obtainable.

The disk plate 30 is provided inside the buffer chamber 29 with the axis line 28 serving as a center thereof, positioned close to the constrictor member 16 but keeping a slight gap L2 provided between the plane 291 of the constrictor member 16. The gap L2 is preferably around 1 to 4 times a diameter d of the constrictor part 35. A diameter D2 of the disk plate 30 is slightly smaller than a diameter D1 of the buffer chamber 29. Preferably, a cylindrical groove 34 whose central axis is the axis line 28 is provided on a plane of the disk 30 on the front side (the constrictor part 35 side). That is to say, the outer shape of the inner space of the groove 34 is of a cylindrical shape whose central axis is the axis line 28. Peripheral edges of the disk plate 30 may be chamfered or rounded. The disk plate 30 partitions the buffer chamber 29 into a storage chamber 294 rear of the disk plate 30 and a disk-shaped rectification space 292 that has a rectifying function. An annular space between a circumferential plane of the disk plate 30 and an inner circumferential plane of the buffer chamber 29 functions as a communication passage 293 that communicates the storage chamber 294 with the rectification space 292. The liquid flows in a flat manner from the storage chamber 294, through the communication passage 293 and from the outer circumference of the rectification space 292 to towards the center, and is ejected from the constrictor part 35.

The shape of the groove 34 may be a truncated cone shape instead of the cylindrical shape, in which its section broadens as it approaches the constrictor part 35 (front side). In the case of a truncated cone shape, the change in sectional area in a radial direction of the inflow channel becomes calm, and can further prevent the vortex generation.

The supporting member 31 is provided on a plane rear of the disk plate 30. The supporting member 31 is molded integrally with the disk plate 30. The supporting member 31 is a substantially cylindrical member including, in order from the front side, a shaft 311, an insertion section 312, and a screw section 313. The shaft 311 is desirably as narrow as possible. If the diameter of the shaft 311 is great, Karman vortex may easily generate on an opposite plane (lower side) of the shaft 311 seen from the flow outlet 122. Therefore, the diameter of the shaft 311 is produced as narrow as possible.

The main body 11 has an insertion hole 36 provided on the same axis as the axis line 28 and opened on the rear side of the main body 11, which insertion hole 36 communicates with the buffer chamber 29. The insertion section 312 fits with and is inserted into the insertion hole 36 of the main body 11. Since the insertion section 312 comes into contact with the step part of the insertion hole 36, the insertion hole 36 can receive the pressure of the liquid within the buffer chamber 29. Therefore, the supporting member 31 will not fall out from the main body 11 from the rear side due to the pressure of the liquid within the buffer chamber 29. Since the insertion section 312 is provided fitting with the insertion hole 36, the supporting member 31 is assembled within the buffer chamber 29 with good accuracy.

The outer circumference of the insertion section 312 is provided with an annular groove. A sealing member 32 is inserted within this annular groove. As the sealing member 32, natural rubber, synthetic rubber, a metal O-ring can be used. The sealing member 32 seals between the insertion section 312 and the insertion hole 36. The screw section 313 protrudes to the rear side of the main body 11, that is, the supporting member 31 is disposed penetrating through the insertion hole 36. Furthermore, the screw section 313 of the supporting member 31 is fixed with a nut that serves as a fixing member. A slotted groove, a hexagon socket, two-way taking may be provided on the rear edge of the screw section 313, to prevent the rotation of the supporting member 31 when the nut 33 is tightened to the screw section 313 of the supporting member 31.

Instead of the cylindrical shape, the shaft 311 may be of a shape having a streamline shaped section through which the axis line 28 passes and which reduces the resistance received from the liquid delivered through the inflow channel 12. In this case, the support member 31 may be configured as having for example a pin or key to restrict the rotation of the supporting member 31.

The housing 21 includes a reception chamber 18 for containing the constrictor member 16, and a jet stream flow channel 211 provided on the same axis as the axis line 28, which jet stream flow channel 211 is opened on the front side and is communicated with the reception chamber 18. The housing 21 is fixed to the main body 11 with a bolt 25 (see FIG. 2) that serves as a pressing member.

The constrictor member 16 includes a smooth flat plane 291 that serves as a wall surface of the buffer chamber 29 on the front side thereof. When the nozzle 10 is assembled, the plane 291 closes the opening of the buffer chamber 29 and defines the plane on the front side of the buffer chamber 29. The outer circumferential plane of the constrictor member 16 fits with the inner circumferential plane of the reception chamber 18 of the housing 21. Moreover, the corner sections of the outer circumferential plane with the plane 291 of the constrictor member 16 has a smoothly finished tapered plane 26. The vertical angle of the tapered plane 26 is formed the same as or slightly smaller than the vertical angle of the tapered plane 27.

By the bolt 25 pressing and fixing the housing 21 against the main body 11, the constrictor member 16 contained in the reception chamber 18 is sandwiched between the housing 21 and the main body 11. Moreover, by the bolt 25 pressing the housing 21 against the main body 11, the tapered plane 26 of the constrictor member 16 comes into contact with the tapered plane 27 of the main body 11 and is pressed. Therefore, the part between the buffer chamber 29 and the constrictor member 16 is liquid sealed. By fastening the housing 21 by using two bolts 25, the housing 21 can be fastened to the main body 11 evenly with respect to the axis line 28. Since the housing 21 is evenly fastened, the constrictor part 35 is fixed on the same axis as the axis line 28. Furthermore, the bolt 25 fixes the constrictor member 16 against the pressure of the liquid applied on the buffer chamber 29. Therefore, if the liquid pressure becomes high, excess axial force acts on the bolt 25. By using two bolts 25 in the horizontal directions, it is possible to reduce the axial diameter of the bolt 25. Therefore, it is possible to reduce a length L3 from the axis line 28 to the bottom plane of the main body 11.

Although the tapered plane 27 is provided at the opening of the buffer chamber 29 and the tapered plane 26 is provided at the corner section of the constrictor member 16, it is not limited to this. For example, instead of this, a smooth annular flat plane may be provided around the opening of the buffer chamber 29, and the plane 291 of the constrictor member 16 may be made into contact with this annular flat surface to liquid seal between the constrictor member 16 and the main body 11. In this case, the constrictor member 16 is securely fixed on the same axis as the axis line 28. Moreover, a hollow cylindrical groove may be provided in the main body 11, so that one part of the outer circumferential plane of the constrictor member 16 is fit with and positioned in the main body 11.

Figure 4:
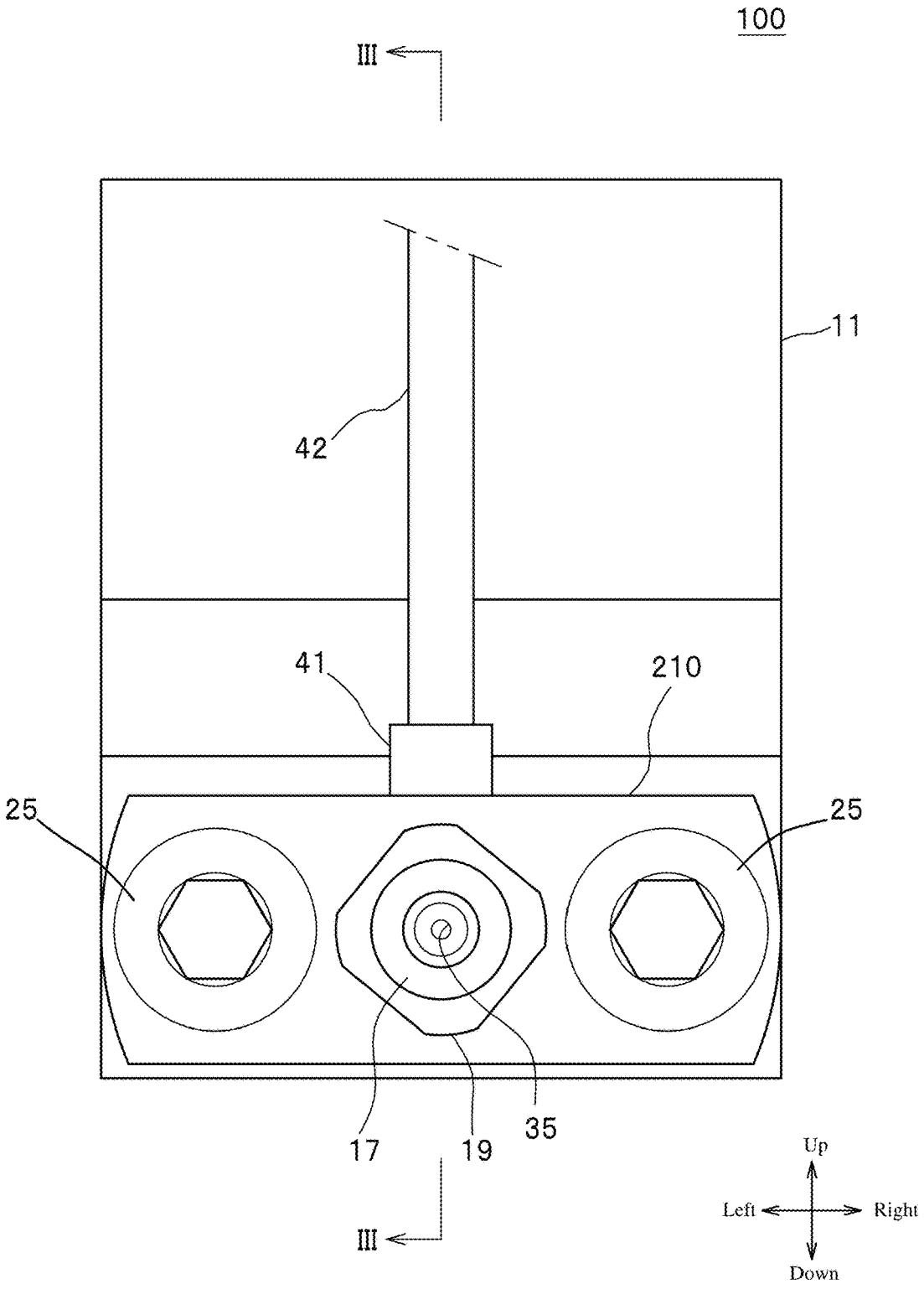
FIG. 4 shows a front view of the nozzle device in the present embodiment.

Next described with reference to FIG. 3 and FIG. 4 is a nozzle device 100 that ejects a jet stream J2 in which an abrasive is mixed into a jet stream J of the liquid (see FIG. 1). FIG. 3 shows a sectional view taken along line III-III in FIG. 4. FIG. 4 is a front view of the nozzle device 100.

The nozzle device 100 ejects the jet stream J2 in which the liquid and an abrasive are mixed together. The nozzle device 100 includes the nozzle 10, a mixing section 40 for mixing the liquid with the abrasive, and an ejection conduit 17. Identical members as with the above nozzle 10 are provided with identical reference numerals, and their descriptions are omitted.

The housing 210 includes an insertion through hole 38 on its front side (outlet side), which insertion through hole 38 is of a hollow cylindrical shape whose central axis is the axis line 28. The insertion through hole 38 communicates with the jet stream flow channel 211. The housing 210 includes an introduction hole 212 for introducing the abrasive.

The mixing section 40 is shaped of a hollow cylinder having a void 402 therein, and is inserted into the insertion through hole 38. The outer circumferential plane of the mixing section 40 fits with the insertion through hole 38. The void 402 communicates with the constrictor part 35 via the jet stream flow channel 211, and is provided on the same axis as the axis line 28. The mixing section 40 has an abrasive flow inlet 401 through which the abrasive is flown into along a direction different from the axis line 28. A recessed section (back facing hole, or a flat plane provided by cutting out a part of the outer circumferential plane) 403 is provided on an opening outside in a radial direction of the abrasive inlet 401. The mixing section 40 is inserted so that the abrasive inlet 401 faces the introduction hole 212.

An adaptor 41 is attached to the introduction hole 212. The adaptor 41 fixes a conduit 42 that serves as a passage for the abrasive. The adaptor 41 restricts the rotating direction of the mixing section 40 by being in contact with the bottom plane of the recessed section 403. The conduit 42 is connected to an abrasive supply means 46.

The ejection conduit 17 is of a hollow cylindrical shape, and is inserted inside the insertion through hole 38. The ejection conduit 17 is provided in front of and adjacent to the mixing section 40. The outer circumferential plane of the ejection conduit 17 fits with the insertion through hole 38. Therefore, the ejection conduit 17 is provided on the same axis as the axis line 28. Since the ejection conduit 17 and the mixing section 40 are fit into the insertion through hole 38 and are disposed on the same axis as the axis line 28, an abrasion amount of the ejection conduit 17 and the mixing section 40 is reduced. The ejection conduit 17 and the mixing section 40 may be integrally molded.

The ejection conduit 17 is fixed by a fixing means 19. The fixing means 19 includes a screwing mechanism 191, and an elastic ring 192 disposed surrounding the outer circumference of the ejection conduit 17. By tightening a nut of the screwing mechanism 191, the elastic ring 192 is urged against the outer plane of the ejection conduit 17, and fixes the ejection conduit 17.

(Flow Analysis)

Hereinafter, a structure of the flow of the liquid within the nozzle 10 of the present embodiment will be described in detail, based on fluid analysis results in two more specific Embodiments.

The Embodiments hereinafter are used for describing the effects of the present invention, and the technical scope of the present invention will not be limited by the following embodiments.

Embodiment 1

D1 is an inner diameter (diameter) of the buffer chamber 29, L1 is a length of the buffer chamber, D2 is an outer diameter (diameter) of the disk plate 30, t is a thickness of the disk plate 30, L2 is a distance between the disk plate 30 and the plane 291, and d is an inner diameter (diameter) of the constrictor part 35. Embodiment 1 is the nozzle 10 of the present embodiment, and is a nozzle 10 whose dimensions are: D1=6 mm, L1=5 mm, D2=5 mm, t=0.75 mm, L2=0.5 mm, d=0.2 mm. The nozzle 10 of the present embodiment does not have the groove 34 provided in the disk plate 30.

Figure 5:
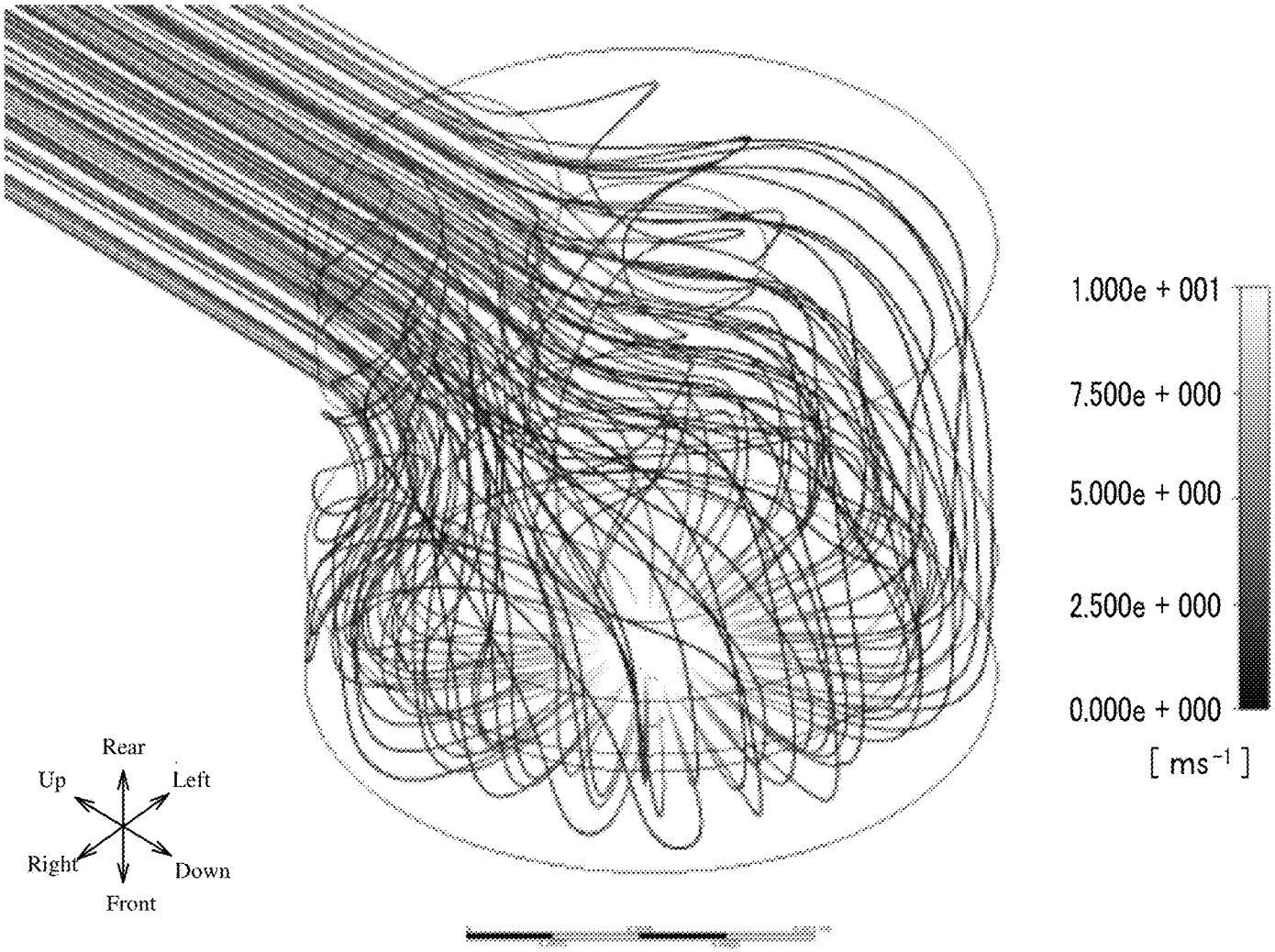
FIG. 5 is a flow line map showing a flow of liquid inside a nozzle in Embodiment 1.
Figure 6:
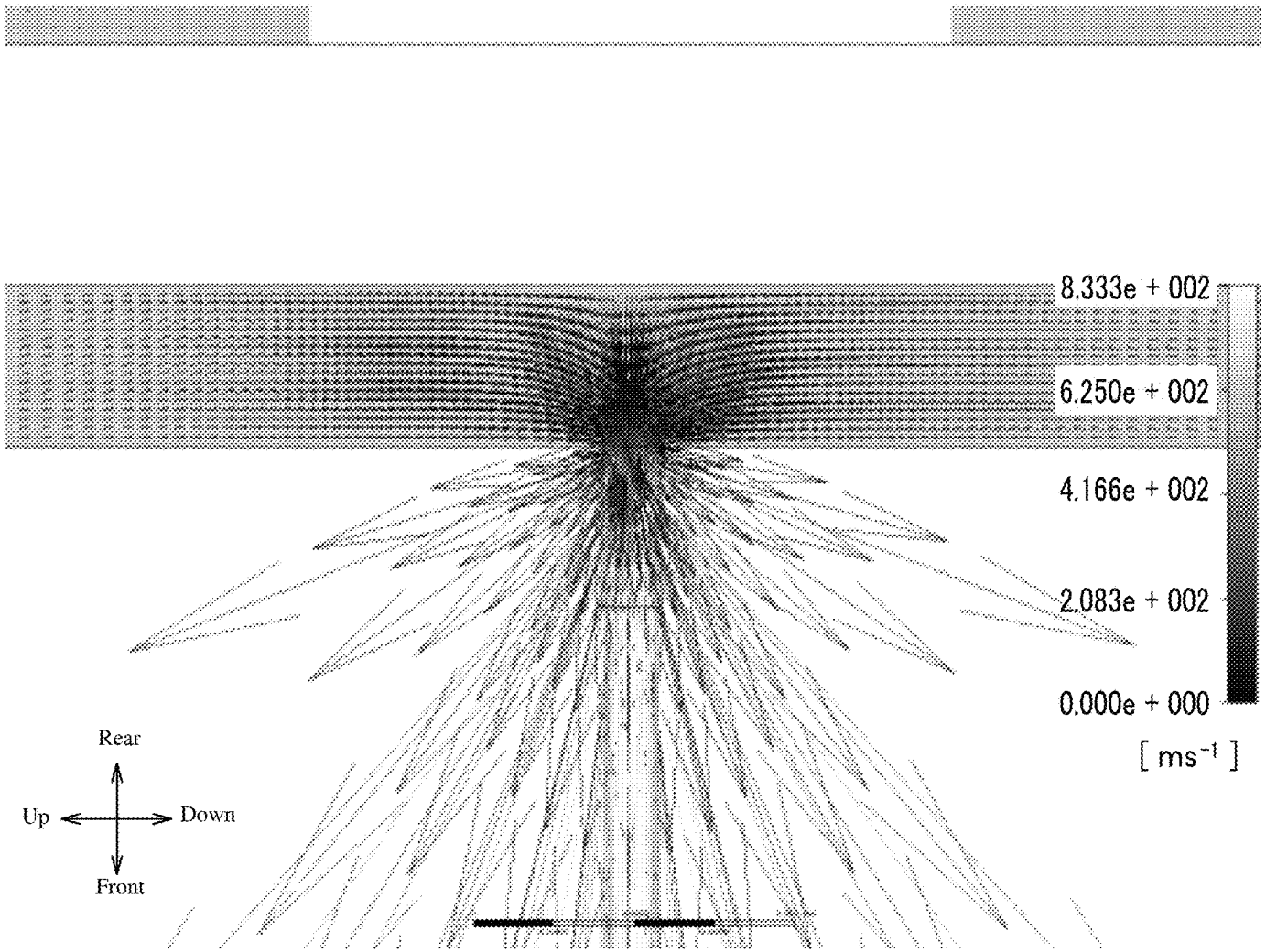
FIG. 6 is a vector plot diagram showing a velocity of the flow of liquid inside the nozzle in Embodiment 1.
Figure 7:
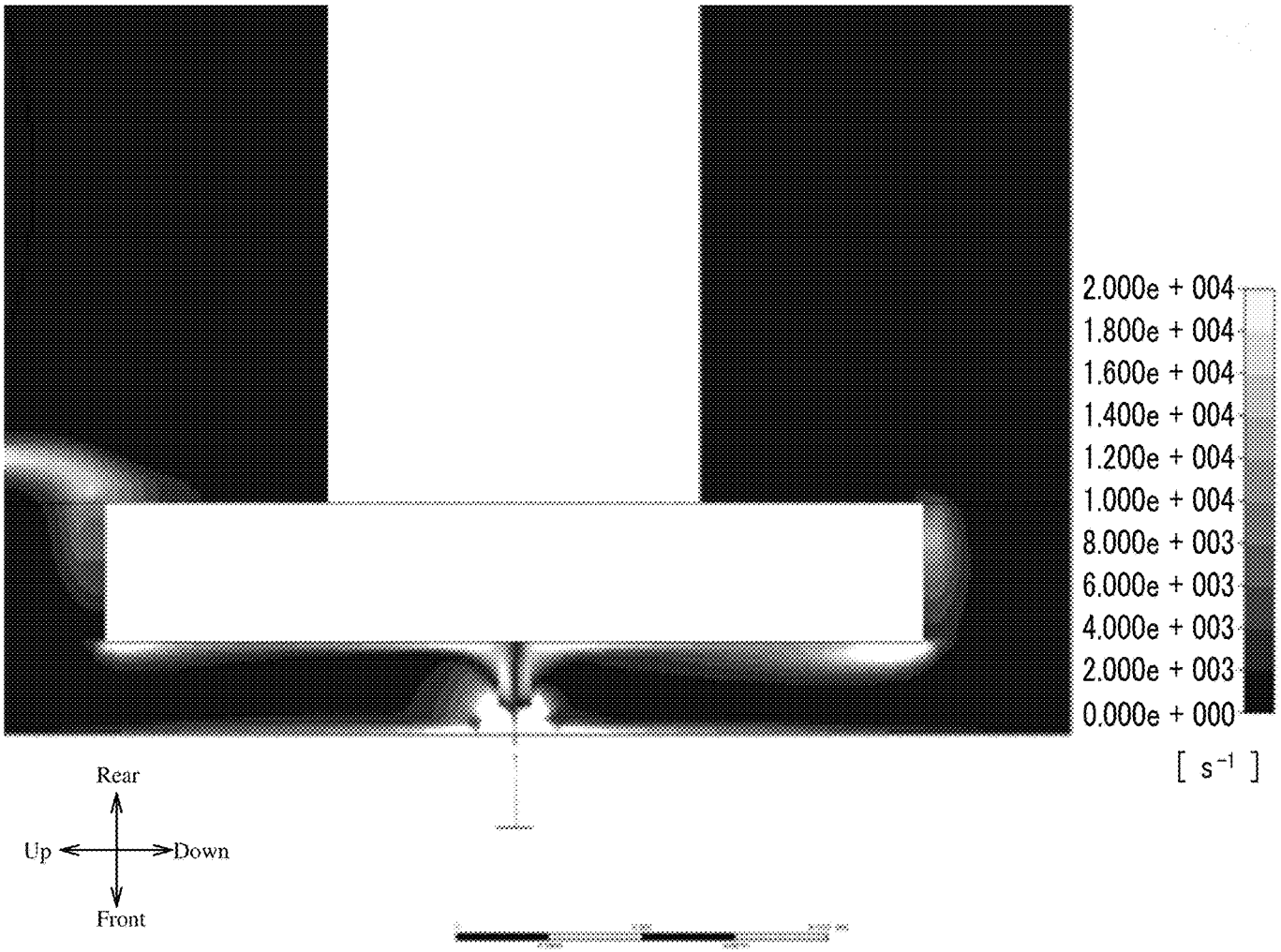
FIG. 7 is a contour diagram showing a vorticity of the flow of liquid inside the nozzle in Embodiment 1.

FIG. 5 to FIG. 7 show a fluid analysis result of the inside of the nozzle of the present Embodiment. The fluid analysis is conducted by using ANSYS CFX-15.0 (general purpose thermal fluid analysis software manufactured by ANSYS). The analysis uses the finite volume method. The fluid is water. The boundary conditions is that the fluid is flown into from the inflow channel 12 at a flow rate of 19.3 [$gs^{-1}$], and the outlet of the constrictor part 35 is air-released. An inner wall plane is of a No Slip Wall. The analysis model is of a steady-state analysis type, and uses the turbulence model. The turbulence model uses k-ε model. The mesh is of a structured grid.

FIG. 5 represents a flow line map of an analysis result viewed diagonally from a rear side thereof (opposite side to the constrictor part 35). The directions of front, rear, left, right, up, and down in FIG. 5 are as shown in the drawing (similarly for FIG. 8). The flow lines are displayed in gray scale, with a lighter color for a faster velocity, and a darker color for a slower velocity. A velocity range exceeding 1.0×10 [$ms^{-1}$] is displayed in white color. The range with the slowest velocity is displayed in black. The liquid flows into the buffer chamber 29 from the flow outlet 122 at a velocity of 2 to 3 [$ms^{-1}$]. The fluid gently spreads throughout the internal space of the storage chamber 294 at a velocity of 1 to 3 [$ms^{-1}$], which is a lower velocity than the flow rate of the inflow channel 12. In the present Embodiment, the shaft 311 is of a cylindrical shape having a diameter of 2 mm, and no large Karman vortex can be seen. The fluid flows from the communication passage 293 surrounding the disk plate 30 to the rectification space 292 in front of the disk plate 30, as though the fluid flows around the disk plate 30. At this time, the liquid flows substantially uniformly in a circumferential direction in the communication passage 293. In the rectification space 292, the fluid flows substantially uniformly in the circumferential direction towards the center of the rectification space 292. At the center of the rectification space 292, the flow suddenly contracts, is redirected into the axis line direction equally from the entire circumference, and flows into the constrictor part 35. Inside the rectification space 292, the flow rate increases in inverse proportion to a square of a radius of the rectification space 292. In the center part of the rectification space 292, the velocity reaches a rate of 6.25 to $8.33\times10^2$ [$ms^{-1}$] that is of the highest velocity (see FIG. 6).

FIG. 6 shows a vector plot diagram showing the velocity of the flow in the I-I section of FIG. 2. The front, rear, up, and down directions in FIG. 6 are as shown in the drawing (similarly for FIG. 9). FIG. 6 shows a portion of the rectification space 292 in an enlarged manner. The size and gradation of the vector represent the velocity. The color of the vector is represented in gray scale, and a velocity near 0 [$ms^{-1}$] is represented by a black color and a velocity exceeding $8.33\times10^2$ [$ms^{-1}$] is represented by a white color. With FIG. 5 and FIG. 6, the velocity display range is largely different. At a position away from the axis line 28, the flow is parallel to the disk plate 30 and is extremely small, at a velocity of 2 to 3 [$ms^{-1}$] (see FIG. 5). The flow is of a layer form substantially parallel to the disk plate 30 until a position extremely close to the axis 28 (around a diameter of 1 mm), and as the flow approaches the center part, the velocity gradually increases. In a range of the diameter of 1 mm, as the direction of vector of the flow is directed to the center, it gradually tilts (changes) to the constrictor part 35 side, and in a very narrow range in the center, the vector is substantially parallel to the axis line 28. This range has a diameter of around 0.1 mm, which is about half of the diameter d of the constrictor part 35. The range parallel to the constrictor part 35 is a range of about half of the diameter d of the constrictor part 35, and in the vicinity of the constrictor part 35, the flow flows into the constrictor part 35 in a state still including the velocity in the radial direction.

The surroundings of the constrictor part are plotted so that the vector is throttled, and the structure of the flow cannot be read well. On the rear side of the constrictor part 35, the velocity increases upon approaching the constrictor part 35 from a side close to the disk plate 30 in the direction of the axis line 28, and reaches the maximum speed of $8.33\times10^2$ [$ms^{-1}$] when passing through the constrictor part.

FIG. 7 is a contour diagram showing a vorticity in the I-I section of FIG. 2. The front, rear, up, and down directions in FIG. 7 is as shown in the drawing (similarly for FIG. 10). The vorticity is displayed in gradations of the gray scale; a white color in a case of a high vorticity, and a black color in a case of a low vorticity. A point with the lowest vorticity is a position farthest away from the constrictor part 35 in the storage chamber 294, and is displayed in the black color. The vorticity appears from mid-degree to relatively high, from the vicinity of the front edge of the flow outlet 122 to the communication passage 293. Furthermore, a vortex of a mid-degree is generated in the vicinity of the bottom side (peripheral plane side of the disk plate 30) of the communication passage 293. Furthermore, a vortex is generated on the bottom side (front plane side of the disk plate 30), rear of the rectification space 292 and along the front plane of the disk plate 30, and the vorticity is the highest in the vicinity of the outer edges on the front plane side of the disk plate 30. This vortex gradually decreases upon approach to the center part of the rectification space 292. The vortex in the vicinity of the front plane of the disk plate 30 spreads thinly substantially axis symmetrically, having the axis line 27 serving as its center, in the center section of the rectification space 292. In the front of the rectification space 292, a vortex is generated thinly and broadly along the plane 291. Furthermore, the vortex is concentrated in a narrow range surrounding the constrictor part 35 in a substantially hemisphere shape. In the vicinity of the radial direction center part of the rectification space 292, the vorticity is slightly low in the cylindrical range from the center part to the rear in the front and rear direction along the axis line 28. Moreover, across a narrow range along the axis line 28 of the radial direction center part of the rectification space 292 (cylindrical range of a diameter 0.04 mm) and across the center part in the axis line 28 direction (front and rear direction) to the disk plate 30, a range with a substantially same diameter as the constrictor part 35 (range of the diameter 0.3 mm) hardly has any vortex generated.

As described above, the liquid flown from the flow outlet 122 into the buffer chamber 29 is received in the storage chamber 294. The liquid spreads gently throughout the whole storage chamber 294, and flows out from the communication passage 293 substantially uniformly from its front peripheral sections. The liquid flows from the storage chamber 294 to the communication passage 293 circumferentially, substantially uniformly in the axis line 28 direction. Furthermore, the liquid flows in from the peripheral sections into the rectification space 292. The liquid flows in the rectification space 292, parallel to the disk plate 30 and uniformly in a radial direction, and increasing its velocity toward the center of the rectification space 292. The direction of this flow rotates at the center of the rectification space 292, in a corolla shape of a morning glory (morning glory shape) so as to be perpendicular to the disk plate 30. In a cylindrical range having the substantially same diameter as the constrictor part 35, the liquid flows into the constrictor part 35 with low turbulence and in high velocity along the axis line 28, with a substantially uniform flow.

The liquid flowing from the flow outlet 122 to the buffer chamber 29 is received in the storage chamber 294, is spread throughout the entire storage chamber 294, is passed through the communication passage 293 and flowed toward the center from the peripheral section of the rectification space 292, and is contracted toward the constrictor part at the center part of the rectification space 292 and ejected, to obtain a jet stream J with low turbulence.

Embodiment 2

In the present embodiment, a fluid analysis result is shown, according to a nozzle in which a groove 34 is added to the disk plate 30 of the nozzle in Embodiment 1. The diameter of the groove 34 is 1.5 mm, and the depth thereof is 0.2 mm Other nozzle shapes and analysis conditions, and further conditions of the diagram drawings are the same as Embodiment 1, and thus detailed descriptions thereof are omitted.

Figure 8:
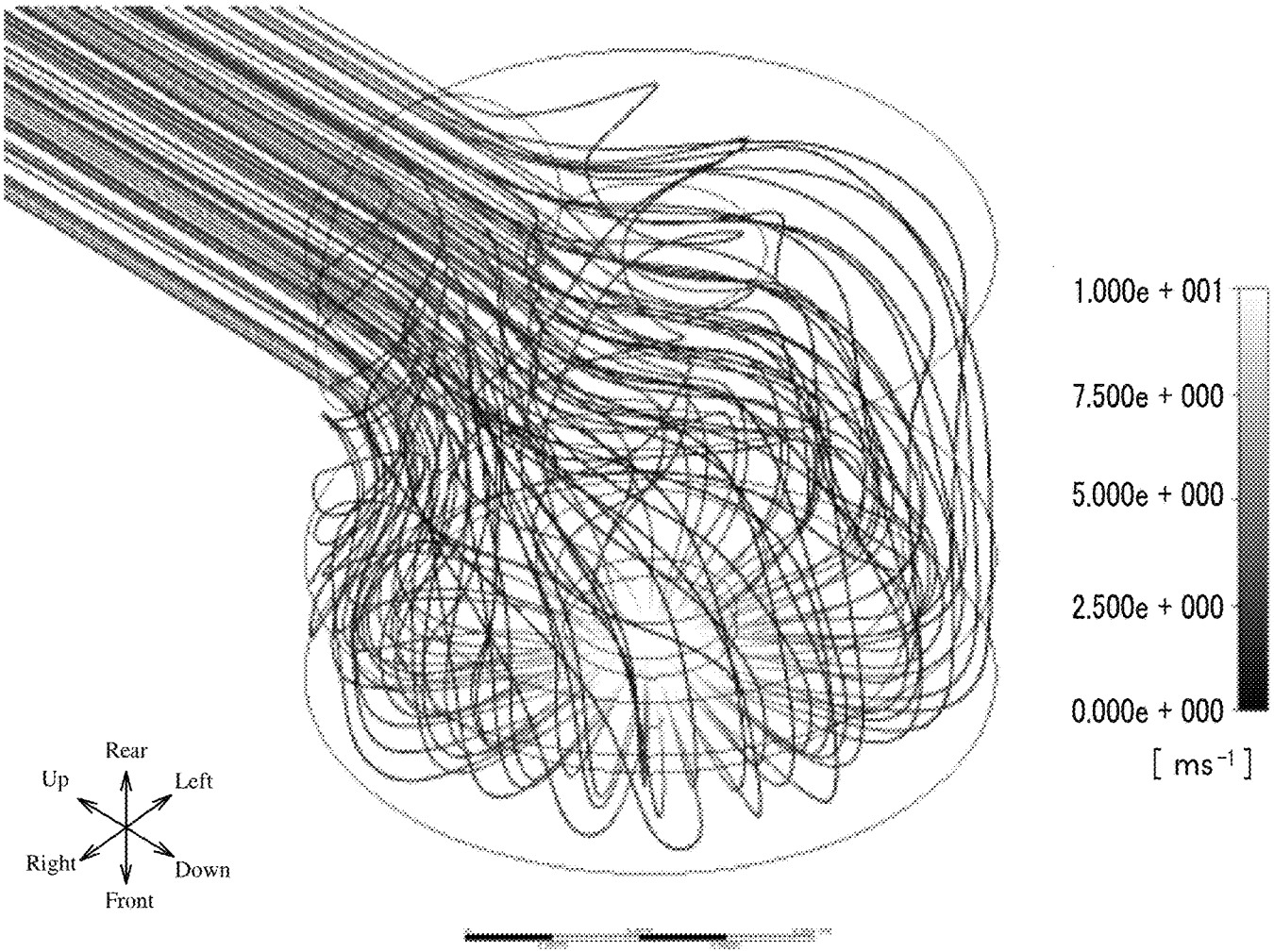
FIG. 8 is a flow line map showing a flow of liquid inside a nozzle in Embodiment 2.

FIG. 8 shows a flow line map of the analysis results seen diagonally from the rear side. The flow line map is substantially the same as Embodiment 1, so detailed descriptions thereof are omitted.

Figure 9:
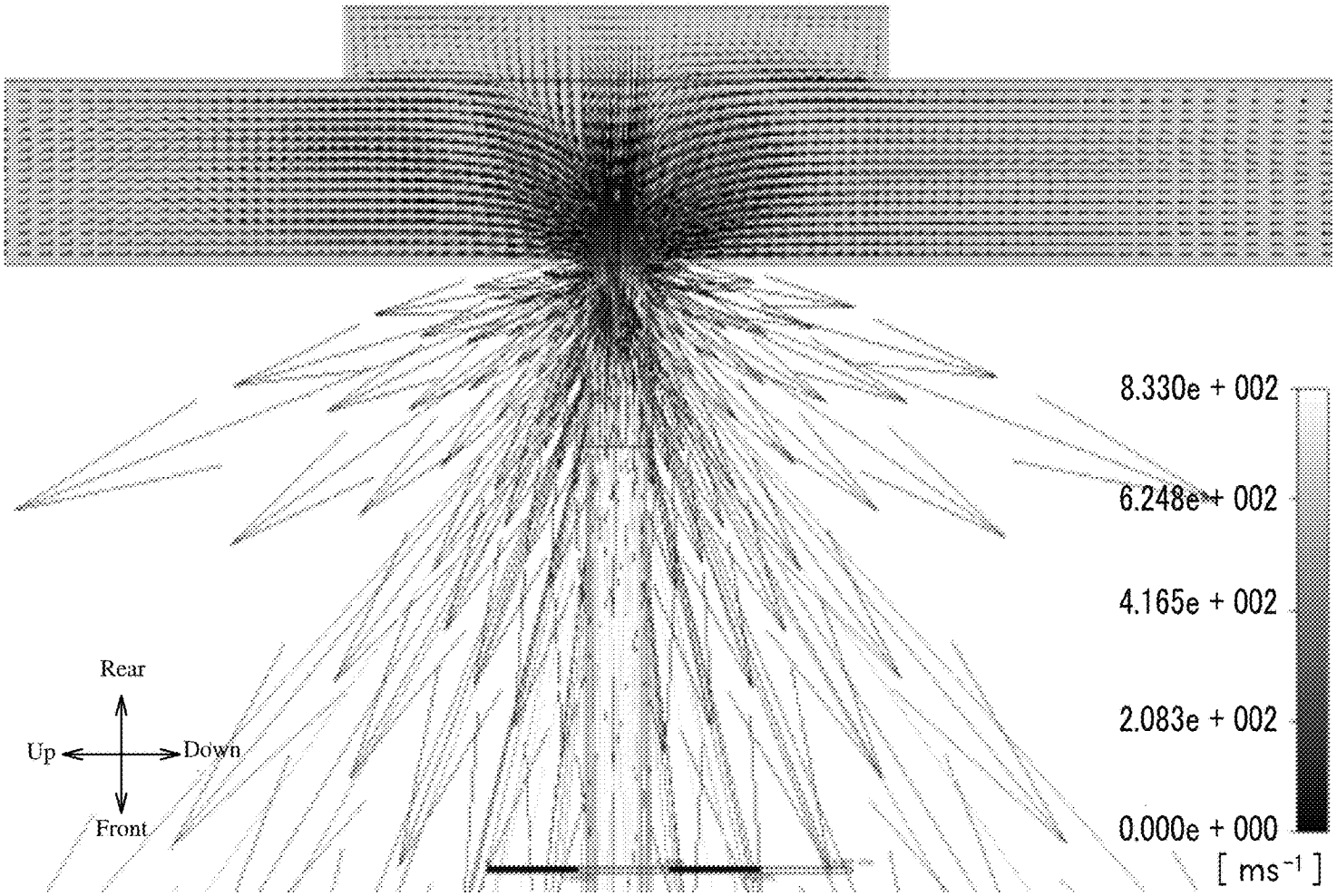
FIG. 9 is a vector plot diagram showing a velocity of the flow of liquid inside the nozzle in Embodiment 2.

FIG. 9 is a vector plot diagram showing the velocity of the flow in the I-I section of FIG. 2. In the present Embodiment also, the direction of the flow tilts (changes) forwards in the vicinity of the center (a range of 1 mm in diameter). In the space rear of the constrictor part 35, a flow parallel to the axis line 28 is generated in a slightly thicker range as compared to Embodiment 1. The range of the flow parallel to the axis 28 is of the range having the diameter of 0.2 mm being the same degree as the constrictor part 35. In the peripheral regions of the groove 34, the liquid flows along the bottom plane of the groove 34 (parallel to the surface of the disk plate 30). Further, in the vicinity of the center of the groove 34, a flow in the axis line direction of a velocity of $2.08\times10^2$ [$ms^{-1}$] or lower is generated. The liquid flows from the entire groove 34 gathering towards the constrictor part 35 in a morning glory form.

In the vicinity of the groove 34 inside the rectification space 292, the flow parallel to the flat plate 30 once gently spreads as like increasing the width in the axis line 28 direction towards the inside of the groove 34. By the liquid spreading as like increasing the width in the direction of the axis line 28, a flow of a layer form parallel to the axis line 28, broadly spread in the radial direction of the axis line 28 as compared to Embodiment 1, is generated. By generating a thick flow parallel to the axis line 28 that is directed to the constrictor part 35, the straightness of the jet stream J can be further enhanced than that in Embodiment 1.

Figure 10:
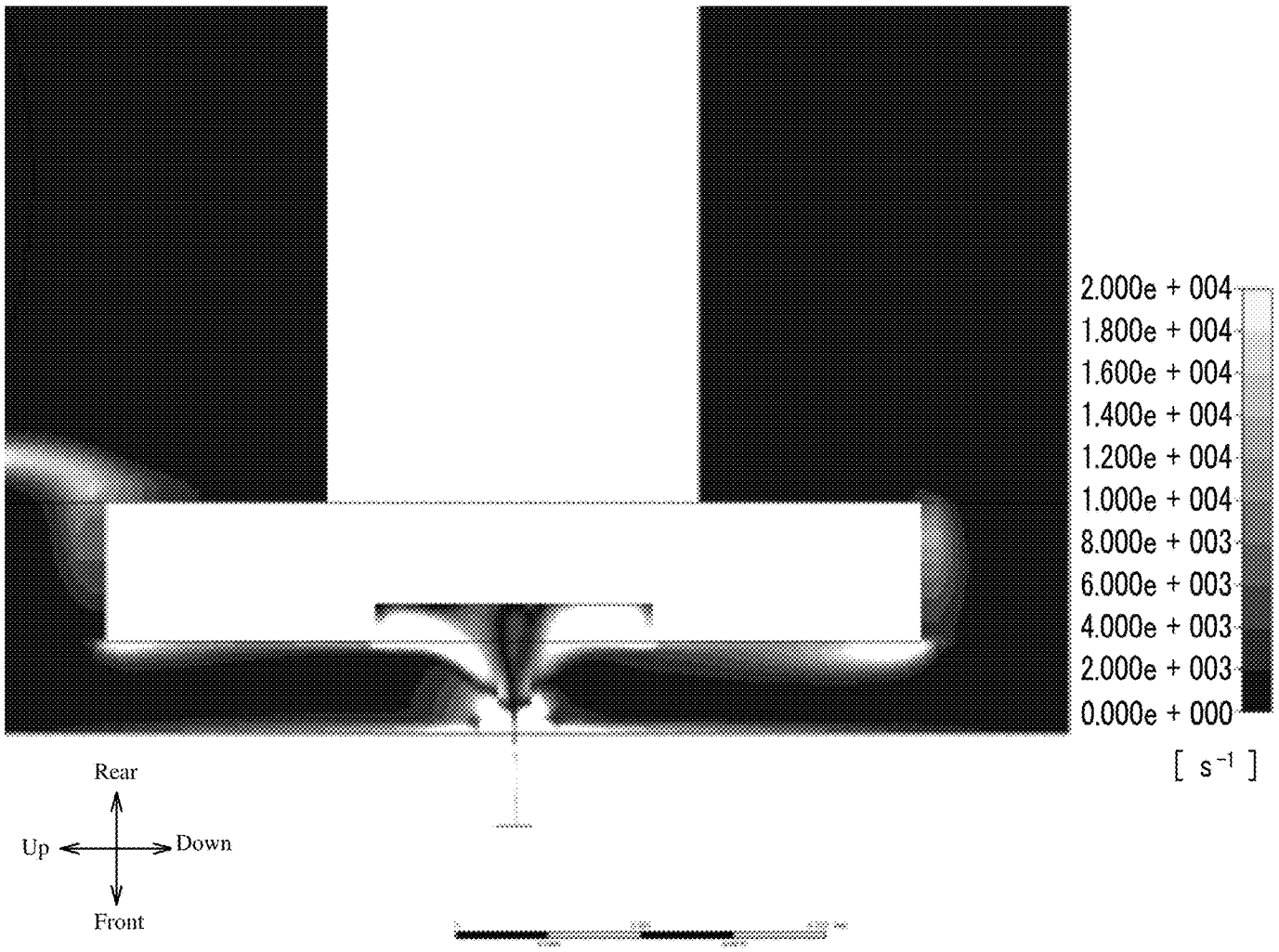
FIG. 10 is a contour diagram showing a vorticity of the flow of liquid inside the nozzle in Embodiment 2.

FIG. 10 is a contour diagram showing a vorticity in the I-I section of FIG. 2. In the present Embodiment, an area with a high vorticity is newly generated in the peripheral section of the groove 34. However, in the present Embodiment, among the region rear of the constrictor part 35, a region with low vorticity once spreads in a radial direction by a diameter of 0.3 mm being of the same degree as Embodiment 1 on a front side (disk plate 30 side) for about half of the height (width in the front and rear direction along the axis line 28) of the rectification space 292, and further spreads broadly in the morning glory form across the bottom plane of the groove 34. The size of the region reaches to a diameter of about 1 mm at the bottom plane of the groove 34. The vorticity is particularly low in the center part of the groove 34.

In the nozzle of the present Embodiment, by having the groove 34 provided in the disk plate 30, a flow is generated directed to the constrictor part 35 as though the liquid is collected in a morning glory form from the space within the groove 34. Further, in the present Embodiment, a flow in a layer form is generated in a range having a large radius as compared to Embodiment 1. Therefore, according to the nozzle of the present Embodiment, the turbulence of the jet stream J ejected from the constrictor part 35 is further small, and thus a jet stream J with high convergence is obtainable.

Application Example

As described above based on the Embodiments, according to the nozzle 10 of the present embodiment, a jet stream J having small turbulence and high convergence is obtainable. In a nozzle device 100 using the nozzle 10, a liquid jet stream J having high straightness and convergence is obtainable, so therefore an abrasion amount of the mixing section 40 and the ejection conduit 17 is reduced. Furthermore, since the straightness of the jet stream J is high, the energy density of the jet stream J2 in which an abrasive is mixed into the jet stream J is also improved.

Moreover, since the inner structure can be formed compact, it is possible to reduce the size of the nozzle 10. In particular, when the fluid pressure exceeds 100 MPa, a large inner stress generates on the members that form the surroundings of the flow channel, and may break these members. Therefore, the thickness of the members of the nozzle 10 had to be large to a certain degree. The nozzle 10 of the present embodiment is of a simple structure and can configure the flow channel section small, so it is extremely suitable for high pressure fluids.

The nozzle 10 and nozzle device 100 of the present embodiment is extremely compact, so it is possible to insert inside a bottomed groove section or hole that is subject to work such as processing, and carry out for example work from a side direction different from the inserting direction. In particular, since there is no structural body on the bottom plane side (deep side seen from the supply opening 121) than the buffer chamber 29, it is possible to make the distance L3 (see FIG. 1, FIG. 3) from the axis line 28 to the bottom surface of the main body 11 extremely small.

REFERENCE SIGNS

10 nozzle
100 nozzle device
11 main body

12 inflow channel
121 supply opening
16 constrictor member
17 ejection conduit
18 reception chamber
19 fixing means
21,210 housing
211 jet stream flow channel
25 bolt (pressing member)
28 axis line
29 buffer chamber
291 plane
30 disk plate
31 supporting member
311 shaft
32 sealing member
33 nut (fixing member)
34 groove
35 constrictor part
36 insertion hole
40 mixing section
401 abrasive inlet

What is claimed is:

1. A nozzle adapted to eject liquid, comprising:

a main body;

a buffer chamber provided in the main body, whose central axis is an axis line serving as a center line of a jet stream of a liquid, which has an internal space whose outer shape is of a cylinder, and which cylinder has a front end plane surface and a rear end surface;

a constrictor part adapted to eject the liquid, provided on the front end plane surface of the buffer chamber in a direction of the axis line and whose central axis is the axis line;

a disk having a front plane surface and a back surface and provided inside the buffer chamber, the front plane surface of the disk facing the front end plane surface of the buffer chamber and whose central axis is the axis line, there being a gap between the front plane surface of the disk and the front end plane surface of the buffer chamber, the disk having a diameter smaller than the diameter of the buffer chamber, and which disk has a groove provided on the front plane surface thereof;

a supporting member adapted to support the disk within the buffer chamber, the supporting member having a shaft provided on the back surface of the disk, the shaft being of a cylindrical shape whose central axis is the axis line;

a supply opening provided in the main body, adapted to supply the liquid; and an inflow channel provided along a direction different from an extending direction of the axis line, and connected to the buffer chamber at a location between the back surface of the disk and the rear end surface of the buffer chamber, the inflow channel communicating with the supply opening, wherein the groove has an internal space whose outer shape is of a cylinder whose central axis is the axis line, or of a truncated cone shape whose section broadens as the internal space approaches the one side, and the disk partitions the buffer chamber into a storage chamber rear of the disk, a disk-shaped rectification space front of the disk, and an annular-shaped communication passage, the storage chamber communicating to the inflow channel, the communication passage being space between a circumferential surface of the disk and an inner circumferential surface of the buffer chamber.

2. The nozzle according to claim 1, wherein the front end plane surface of the buffer chamber is adapted to be opened, the constrictor part is provided in a hollow cylindrical constrictor member whose central axis is the axis line, the constrictor member is adapted to close the opening on the front end plane surface of the buffer chamber, and the nozzle further comprises:

a housing having a reception chamber adapted to contain the constrictor member and a jet stream flow channel provided on the same axis as the axis line, the jet stream flow channel opened on the front end plane surface of the buffer chamber and communicated with the reception chamber; and a pressing member adapted to sandwich the constrictor member contained within the reception chamber between the housing and the main body by pressing and fixing the housing toward the main body.

3. The nozzle according to claim 1, wherein the main body has an insertion hole provided on the same axis as the axis line and opened on the other side of the main body, the insertion hole communicating with the buffer chamber, the supporting member is disposed penetrating through the insertion hole, and the nozzle further comprises:

a sealing member adapted to seal between the supporting member and the insertion hole; and a fixing member adapted to fix the supporting member to the main body from the other side.

4. A nozzle device having a nozzle as set forth in claim 1, the nozzle device adapted to eject liquid upon mixing an abrasive medium into a jet stream of the liquid, the nozzle device comprising:

a hollow cylindrical mixing section having an inlet end and provided on an end of the constrictor part that is opposite the end of the constrictor part that is on the front end plane surface of the buffer chamber, and communicating with the constrictor part and on the same axis as the axis line, the mixing section having an abrasive flow inlet via which the abrasive medium is flowed into along a direction different from an extending direction of the axis line; and a hollow cylindrical ejection conduit provided on an outlet end of the mixing section, communicating with the mixing section and on the same axis as the axis line.

5. The nozzle according to claim 1, wherein the gap is 1 to 4 times a diameter of the constrictor part.

6. The nozzle according to claim 1, wherein the groove has an internal space whose outer shape is of a cylinder whose central axis is the axis line.

7. The nozzle according to claim 1, wherein the groove has an internal space whose outer shape is of truncated cone shape whose section broadens as the internal space approaches the one side.

* * * * *